US010382850B2

(12) United States Patent
Zhang

(10) Patent No.: US 10,382,850 B2
(45) Date of Patent: Aug. 13, 2019

(54) SPRING SHEET, ELECTROACOUSTIC DEVICE, AND ELECTRONIC DEVICE

(71) Applicant: AAC Technologies Pte, Ltd., Singapore (SG)

(72) Inventor: Guqing Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 3 days.

(21) Appl. No.: 15/870,110

(22) Filed: Jan. 12, 2018

(65) Prior Publication Data

US 2018/0343508 A1 Nov. 29, 2018

(30) Foreign Application Priority Data

May 26, 2017 (CN) ..... 2017 2 0603833 U
May 26, 2017 (CN) ..... 2017 2 0603887 U

(51) Int. Cl.
*H04R 1/02* (2006.01)
*H04R 7/20* (2006.01)
*H04R 31/00* (2006.01)

(52) U.S. Cl.
CPC ..... *H04R 1/025* (2013.01); *H04R 1/026* (2013.01); *H04R 7/20* (2013.01); *H04R 31/006* (2013.01); *H04R 2201/02* (2013.01)

(58) Field of Classification Search
None
See application file for complete search history.

(56) References Cited

U.S. PATENT DOCUMENTS

2013/0016874 A1* 1/2013 Huang ..... H04R 9/043 381/433
2014/0056465 A1* 2/2014 Li ..... H04R 9/025 381/400
2014/0241566 A1* 8/2014 Choi ..... H04R 9/04 381/400
2015/0188398 A1* 7/2015 Zhang ..... H04R 9/02 310/28
2015/0189442 A1* 7/2015 Zhang ..... H04R 9/025 381/409
2017/0034626 A1* 2/2017 Zhang ..... H04R 9/025

* cited by examiner

*Primary Examiner* — Paul W Huber
(74) *Attorney, Agent, or Firm* — Na Xu; IPro, PLLC

(57) ABSTRACT

The present disclosure relates to a spring sheet, an electroacoustic device and an electronic device. The spring sheet, for an electroacoustic device including a holder and a magnetic unit accommodated in the holder, includes: a main body, the main body comprising a magnetic unit fixing portion and a holder fixing portion; wherein the magnetic unit fixing portion is configured to be fixedly connected with the magnetic unit, the holder fixing portion is configured to be fixedly connected with the holder, and the main body is shaped in a non-circular enclosed ring structure. By such configuration, the spring sheet can be applied in a non-circular three-in-one product, and stress of the spring sheet can be effectively dispersed, which can fundamentally solve the problem that the arm of force of the spring sheet deforms and lose efficacy when the product falls off, thereby extending service life of the spring sheet.

16 Claims, 5 Drawing Sheets

SPRING SHEET, ELECTROACOUSTIC DEVICE, AND ELECTRONIC DEVICE

TECHNICAL FIELD

The present disclosure relates to the field of vibratory sounding techniques and, particularly, relates to a spring sheet, an electroacoustic device containing the spring sheet and an electronic device containing the electroacoustic device.

BACKGROUND

With the rapid development of electronic information technologies, more and more electroacoustic devices are applied in electronic products of various types and, particularly, in the mobile communication equipment widely used in people's life. Not only miniaturization and multifunction of the electroacoustic device have been concerned, but also sound effect with high quality and no sound distortion are highly demanded.

Generally, a spring sheet used in a conventional electroacoustic device is an unenclosed structure, however, such spring sheet cannot effectively resolve the stress of the spring sheet, and thus deformation readily occurs when the product falls off.

In view of this, it is necessary to provide a new spring sheet.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure.

Figure 1:
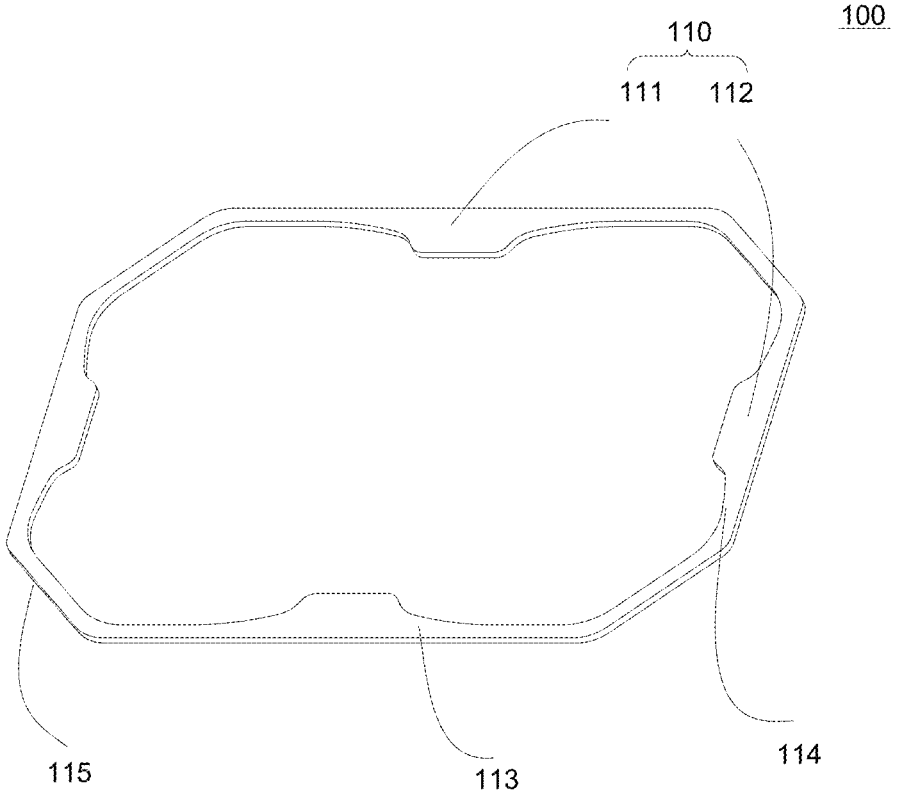
FIG. 1 is a structural schematic diagram of a spring sheet according to Embodiment 1.

The drawings herein are incorporated in the specification and form one section of the specification, which have shown embodiments of the present disclosure and are used together with the specification to explain the principle of the present disclosure.

DESCRIPTION OF EMBODIMENTS

The present disclosure will be described in further detail with reference to the following embodiments and the accompanying drawings.

Embodiment 1

As shown in FIGS. 1-4, a first aspect of Embodiment 1 of the present disclosure provides a spring sheet 100. The spring sheet 100 can be applied in an electroacoustic device 200. The electroacoustic device 200 may include a holder 230 and a magnetic unit 210 accommodated in the holder

230. The spring sheet 100 includes a main body 110, and the main body includes a magnetic unit fixing portion 111 and a holder fixing portion 112. The magnetic unit fixing portion 111 is used for fixedly connecting with the magnetic unit 210 of the electroacoustic device 200, and the holder fixing portion 112 is used for fixedly connecting with the holder 230 of the electroacoustic device 200. The main body 110 is constructed in a non-circular enclosed ring.

Since the main body 110 is constructed in a non-circular enclosed ring, the spring sheet 100 of the present embodiment can be applied in a non-circular three-in-one product, and such a non-circular enclosed ring structure can also effectively disperse the stress of the spring sheet 100, which can fundamentally solve the problem that the arm of force of the spring sheet deforms and loses efficacy when the non-circular three-in-one product falls off, thereby extending the service life of the spring sheet 100. As for a product using the spring sheet 100, for example, an electroacoustic device 200, since the spring sheet 100 can effectively disperse the stress, the service life of the electroacoustic device 200 can also be extended, thereby reducing the cost.

It should be noted that, the present disclosure has no limitation on the specific configuration of the main body 110, as long as it is shaped in an enclosed ring and is non-circular. For example, the main body 110 may be quadrilateral or even polygonal, etc.

The configuration of the electroacoustic device 200 can refer to the second aspect of the present embodiment, which is not repeated herein.

As shown in FIG. 1, the main body 110 of the spring sheet 100 has a long-axis direction and a short-axis direction. The main body 110 includes two first sidewalls 113 opposite to each other and two second sidewalls 114 opposite to each other. The two first sidewalls 113 extend along the long-axis direction, and the two second sidewalls 114 extend along the short-axis direction. The two first sidewalls 113 and the two second sidewalls 114 cooperatively form the above-mentioned enclosed ring structure. That is, the main body 110 is substantially rectangular. It is also possible that, when a length of the main body 110 along the long-axis direction is equal to a length of the main body 110 along the short-axis direction, the main body 110 can be substantially square. Such a spring sheet 100 is easy for manufacturing, and can further effectively disperse the stress of the spring sheet 100, which can fundamentally solve the problem of the non-circular three-in-one product in which the arm of force of the spring sheet deforms and loses efficacy when the product falls off.

In addition, as shown in FIG. 1, an oblique portion 115 is formed between each first sidewall 113 and its adjacent second sidewall 114. An included angle between the oblique portion 115 and each adjacent first sidewall 113 may be in a range of 120°-150°. Such a oblique portion can further eliminate the stress, thereby further extending the service life of the spring sheet 100.

As shown in FIG. 1, a first extending portion protruding towards the geometric center of the spring sheet is formed at an inner side of each first sidewall 113, and the first extending portion forms the magnetic unit fixing portion 111. The term "inner side" herein refers to a side of the first sidewall 113 close to the geometric center of the spring sheet, i.e., an inner wall side surrounding to define the annular main body of the spring sheet.

Figure 2:
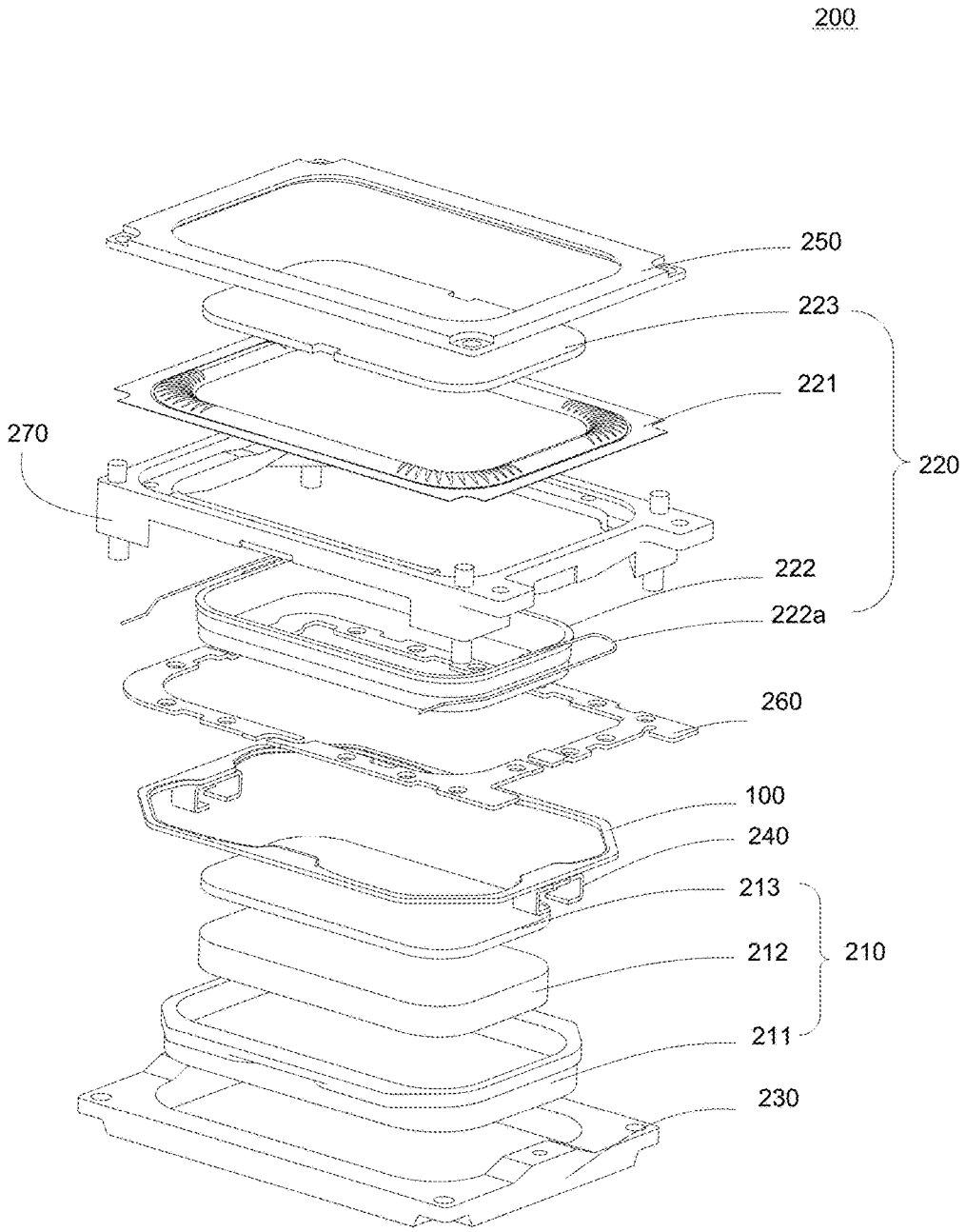
FIG. 2 is an exploded schematic diagram of an electroacoustic device according to Embodiment 1.
Figure 3:
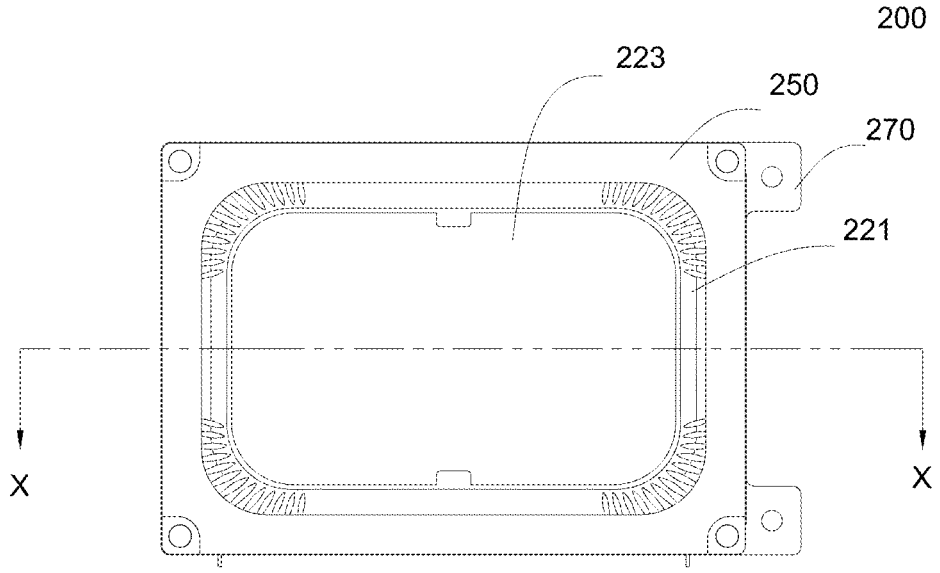
FIG. 3 is a front view of an electroacoustic device according to Embodiment 1.
Figure 4:
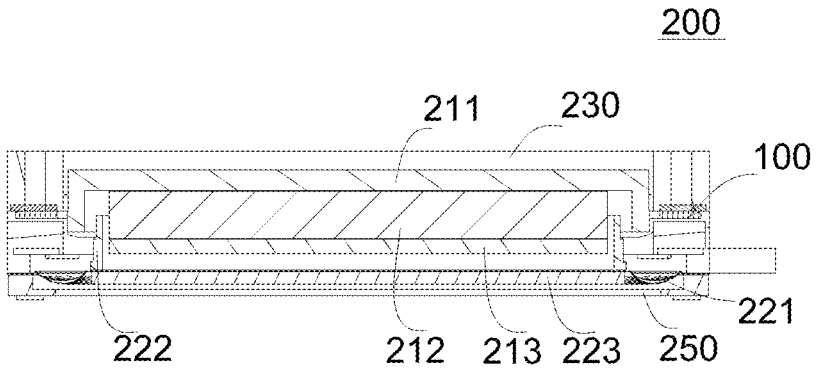
FIG. 4 is a cross-sectional view along direction X-X in FIG. 3.

When the spring sheet 100 of the present embodiment is applied in the electroacoustic device 200, the magnetic unit fixing portion 111 is connected with a magnetic frame 211 (as shown in FIG. 2) of the magnetic unit 210. Specifically, a connecting portion (not shown in the figures) can be provided at a position on the magnetic frame 211 corresponding to the magnetic unit fixing portion 111, for connecting with the magnetic unit fixing portion 111, thereby suspending the magnetic frame 211 in the holder 230. Therefore, such a spring sheet 100 can well support the magnetic unit 210, so as to suspend the magnetic unit 210 in the holder 230.

In the present embodiment, the magnetic unit fixing portion 111 can be located on a center portion of the first sidewall 113. Accordingly, when assembling the spring sheet 100 to form the electroacoustic device, on the one hand, the magnetic unit fixing portion 111 can serve as an assembling reference for avoiding assembling error, on the other hand, the spring sheet 100 is easy for manufacturing and cost saving. Moreover, the spring sheet 100 can further eliminate the stress and thus have further extended service life.

Further, as shown in FIG. 1, a second extending portion protruding towards the geometric center of the spring sheet is formed at an inner side of each second sidewall 114, and the second extending portion forms the holder fixing portion 112. The term "inner side" herein refers to a side of the first sidewall 113 close to the geometric center of the spring sheet, i.e., the inner wall side surrounding to define the annular of the main body of the spring sheet.

When the spring sheet 100 of the present embodiment is applied in an electroacoustic device 200, the holder fixing portion 112 is fixedly connected with the holder 230, thereby fixing the holder 230.

It should be understood that, the portion of the main body 110, which is not connected with the holder 230 and the magnetic unit 210, is elastic and can deform elastically.

The holder fixing portion 112 is located at the middle of the second sidewall 114. Thus, when assembling the electroacoustic device with such spring sheet 100, on the one hand, the holder fixing portion 112 can serve as an assembling reference for avoiding assembling error, on the other hand, such a spring sheet 100 is easy for manufacturing and cost saving. Moreover, such spring sheet 100 can further eliminate the stress and thus have further extended service life.

A second aspect of Embodiment 1 provides an electroacoustic device 200. The electroacoustic device 200 includes a holder 230, a magnetic unit 210 and a vibration unit 220. The magnetic unit 210 and the vibration unit 220 are accommodated in the holder 230. The electroacoustic device 100 further includes the spring sheet 100 as described above, the magnetic unit fixing portion 111 is fixedly connected with the magnetic unit 210, and the holder fixing portion 112 is fixedly connected with the holder 230.

As shown in FIG. 1 and FIG. 2, the electroacoustic device 200 further includes a frame 270 fixedly connected with the holder 230, the frame 270 and the holder 230 cooperatively define an accommodating space, for accommodating the magnetic unit 210 and the vibration unit 220. The magnetic unit 210 includes a magnetic frame 211, a main magnet 212 located in the magnetic frame 211, and a pole plate 213 attached onto the main magnet 212. The electroacoustic device 200 further includes a support member 240 located at an end portion of the holder 230 in the long-axis direction. One end of the support member 240 is fixedly connected with the holder 230, and the other end of the support member 240 is fixedly connected with the holder fixing portion 112 of the spring sheet 100, thereby suspending the magnetic unit 210 in the holder 230.

The vibration unit 220 includes a voice diaphragm 221, a voice coil 222 configured to drive the voice diaphragm 221 to vibrate, and a dome 223 fixing the voice diaphragm 221 above the voice coil 222. The voice coil 222 is inserted in a magnetic gap of the magnetic frame 211, and a leading-out wire **222*a* of the voice coil 222 is electrically connected with a flexible circuit board 260, so that the voice coil 222 is connected with an external power supply by the flexible circuit board 260**.

The electroacoustic device 200 further includes an end cover 250, and the end cover 250 covers a peripheral portion of the dome 223 and a peripheral portion of the voice diaphragm 221, wherein the voice diaphragm 221 protrudes towards the end cover 250.

Herein, the spring sheet 100 described above is applied in the electroacoustic device 200, the electroacoustic device 200 is a three-in-one product which is non-circular in size, and the spring sheet 100 is constructed in a non-circular enclosed ring and is well adapted to the electroacoustic device 200 in shape, which can effectively disperse the stress of the spring sheet 100, and thus fundamentally solve the problem that the arm of force of the spring sheet deforms and loses efficacy when the non-circular three-in-one product falls off, thereby extending the service life of the spring sheet 100, and thus extending the service life of the electroacoustic device 200 and saving the cost.

A third aspect of Embodiment 1 provides an electronic device. The electronic device includes the electroacoustic device, and the electroacoustic device can be the electroacoustic device 200 as described above.

It should be noted that, the electronic device can also be a cell phone, a laptop computer, or other electronic products.

Embodiment 2

Figure 5:
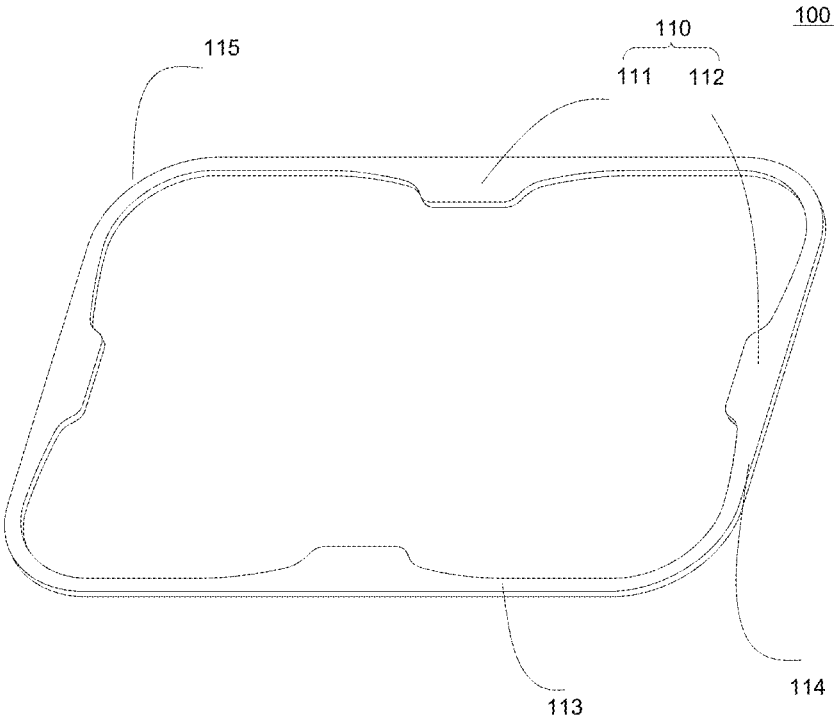
FIG. 5 is a structural schematic diagram of a spring sheet according to Embodiment 2.
Figure 6:
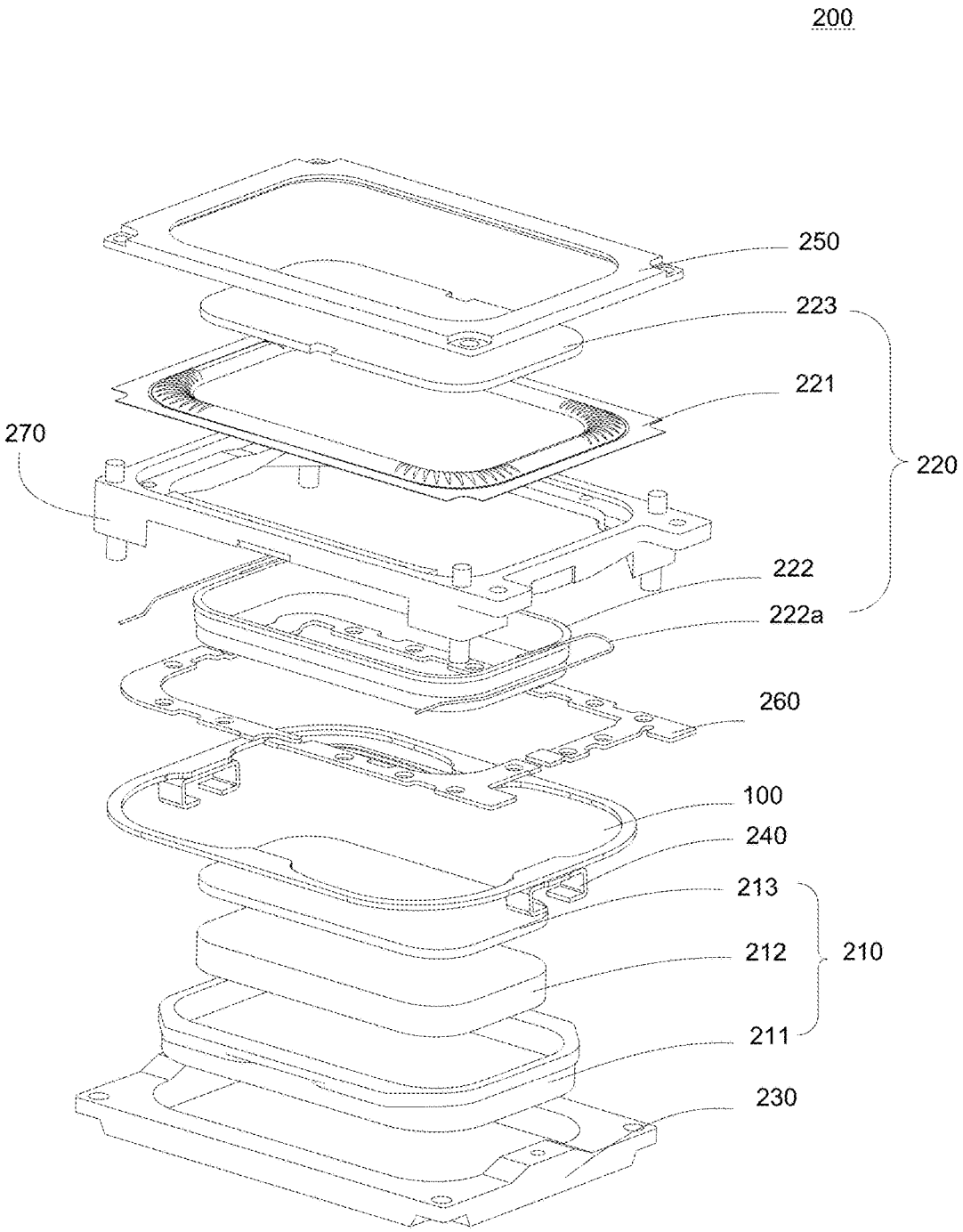
FIG. 6 is an exploded schematic diagram of an electroacoustic device according to Embodiment 2.

As shown in FIGS. 5-6, a first aspect of Embodiment 2 of the present disclosure provides a spring sheet 100. The spring sheet 100 includes a main body 110. The main body 110 includes a magnetic unit fixing portion 111 and a holder fixing portion 112. The magnetic unit fixing portion 111 is configured to be fixedly connected with a magnetic unit 210 of an electroacoustic device 200, and the holder fixing portion 112 is configured to be fixedly connected with a holder 230 of the electroacoustic device 200. The main body 110 is shaped in a non-circular enclosed ring structure, and an oblique portion 115 is provided at a turning corner of the non-circular enclosed ring structure.

In the present embodiment, the main body 110 is shaped in a non-circular enclosed ring structure, and an oblique member 115 is formed at a turning corner of the non-circular enclosed ring structure. That is, the spring sheet 100 can be applied in a three-in-one product that is non-circular in size; in addition, the main body 110 is shaped in a non-circular enclosed ring structure, and an oblique portion is provided at a turning corner of the non-circular enclosed ring structure, the stress on the spring sheet 100 can be effectively dispersed, which fundamentally solves the problem that the arm of force of the spring sheet deforms and loses efficacy when the non-circular three-in-one product falls off, thereby extending the service life of the spring sheet 100. As for a product using the spring sheet 100, for example, an electroacoustic device, since the spring sheet 100 can effectively disperse the stress, the service life of the electroacoustic device can also be extended, thereby reducing the cost.

It should be noted that, the present disclosure has no limitation on the specific configuration of the main body 110 of the spring sheet 100, as long as it is shaped in an enclosed ring and is non-circular. For example, the main body 110 may be quadrilateral or even polygonal, etc.

It should also be noted that, the present disclosure has no limitation on the size of the oblique portion 115, as long as the size of the fillet can be processed according to actual demands, so as to ensure sufficient strength and meanwhile eliminate the stress.

As shown in FIG. 5, the main body 110 of the spring sheet 100 has a long-axis direction and a short-axis direction. The main body 110 includes two first sidewalls 113 opposite to each other and two second sidewalls 114 opposite to each other. The two first sidewalls 113 extend along the long-axis direction, and the two second sidewalls 114 extend along the short-axis direction. The two first sidewalls 113 and the two second sidewalls 114 cooperatively define the enclosed ring structure.

That is to say, the main body 110 is substantially rectangular. It is also possible that, when a length of the main body 110 along the long-axis direction is equal to a length of the main body 110 along the short-axis direction, the main body 110 can be substantially square. Such a spring sheet 100 is easy for manufacturing, and can further effectively disperse the stress of the spring sheet 100, which can fundamentally solve the problem of the non-circular three-in-one product in which the arm of force of the spring sheet deforms and loses efficacy when the product falls off. As for a product using such spring sheet 100, for example, an electroacoustic device, since the spring sheet 100 can effectively disperse the stress, the service life of the electroacoustic device can also be extended, thereby reducing the cost.

In addition, as shown in FIG. 5, a first extending portion protruding towards the geometric center of the spring sheet is formed at an inner side of each first sidewall 113, and the first extending portion forms the magnetic unit fixing portion 111. The term "inner side" in the present embodiment refers to a side of the first sidewall 113 close to the geometric center of the spring sheet, i.e., an inner wall side surrounding to define the annular main body of the spring sheet.

When the spring sheet 100 of the present embodiment is applied in the electroacoustic device 200 the magnetic unit fixing portion 111 is connected with a magnetic frame 211 (as shown in FIG. 6) of the magnetic unit 210. Specifically, a connecting portion (not shown in the figures) can be formed at a position on the magnetic frame 211 corresponding to the magnetic unit fixing portion 111, for connecting with the magnetic unit fixing portion 111, thereby suspending the magnetic frame 211 in the holder 230. Therefore, such a spring sheet 100 can well support the magnetic unit 210, so as to suspend the magnetic unit 210 in the holder 230.

In the present embodiment, the magnetic unit fixing portion 111 can be located at the middle of each first sidewall 113.

Accordingly, when assembling the electroacoustic device with the spring sheet 100, on the one hand, the magnetic unit fixing portion 111 can serve as an assembling reference for avoiding assembling error, on the other hand, the spring sheet 100 is easy for manufacturing and cost saving. Moreover, the spring sheet 100 can further eliminate the stress and thus have further extended service life.

Further, as shown in FIG. 5, a second extending portion protruding towards the geometric center of the spring sheet is provided at an inner side of each second sidewall 114, and the second extending portion forms the holder fixing portion 112. The term "inner side" herein refers to a side of the first sidewall 113 close to the geometric center of the spring sheet, i.e., the inner wall side surrounding to define the annular of the main body of the spring sheet.

When the spring sheet 100 of the present embodiment is applied in an electroacoustic device 200, the holder fixing portion 112 is fixedly connected with the holder 230, thereby fixing the holder 230.

It should be understood that, the portion of the main body 110, which is not connected with the holder 230 and the magnetic unit 210, is elastic and can deform elastically.

As shown in FIG. 5, the holder fixing portion 112 is located at the middle of each second sidewall 114.

Accordingly, when assembling the electroacoustic device with such spring sheet 100, on the one hand, the holder fixing portion 112 can serve as an assembling reference for avoiding assembling error, on the other hand, such spring sheet 100 is easy for manufacturing and cost saving. Moreover, such spring sheet 100 can further eliminate the stress and thus have further extended service life.

As shown in FIG. 5, the oblique portion 115 is arranged between the first sidewall 113 and its adjacent second sidewall 114, so that the stress can be further eliminated, thereby extending the service life of the spring sheet 100.

A second aspect of Embodiment 2 provides an electroacoustic device 200. The electroacoustic device 200 includes a holder 230, a magnetic unit 210 and a vibration unit 220. The magnetic unit 210 and the vibration unit 220 are accommodated in holder 230. The electroacoustic device 100 further includes the spring sheet 100 as described above, the magnetic unit fixing portion 111 is fixedly connected with the magnetic unit 210, and the holder fixing portion 112 is fixedly connected with the holder 230.

As shown in FIGS. 5 and 6, the electroacoustic device 200 further includes a frame 270 fixedly connected with the holder 230, the frame 270 and the holder 230 cooperatively define an accommodating space, for accommodating the magnetic unit 210 and the vibration unit 220. The magnetic unit 210 includes a magnetic frame 211, a main magnet 212 located in the magnetic frame 211, and a pole plate 213 attached onto the main magnet 212. The electroacoustic device 200 further includes a support member 240 located at an end portion of the holder 230 in the long-axis direction. One end of the support member 240 is fixedly connected with the holder 230, and the other end of the support member 240 is fixedly connected with the holder fixing portion 112 of the spring sheet 100, thereby suspending the magnetic unit 210 in the holder 230.

The vibration unit 220 includes a voice diaphragm 221, a voice coil 222 configured to drive the voice diaphragm 221 to vibrate, and a dome 223 fixing the voice diaphragm 221 above the voice coil 222. The voice coil 222 is inserted in a magnetic gap of the magnetic frame 211, and a leading-out wire **222*a* of the voice coil 222 is electrically connected with a flexible circuit board 260, so that the voice coil 222 is connected with an external power supply by the flexible circuit board 260**.

The electroacoustic device 200 further includes an end cover 250, and the end cover 250 covers a peripheral portion of the dome 223 and a peripheral portion of the voice diaphragm 221, wherein the voice diaphragm 221 protrudes towards the end cover 250.

A third aspect of Embodiment 2 provides an electronic device (not shown in the figures). The electronic device includes the electroacoustic device, and the electroacoustic device can be the electroacoustic device 200 as described above.

It should be noted that, the electronic device can also be a cell phone, a laptop computer, or other electronic products.

The above description only shows optional embodiments of the present disclosure and is not intended to limit the present disclosure. Various replacements and modifications may be made by those skilled in the art. Any modifications, equivalent replacements, improvements and the like made within the spirit and principles of the present disclosure should be included in the protection scope of the present disclosure.

What is claimed is:

1. A spring sheet, applied in an electroacoustic device, the electroacoustic device comprising a holder and a magnetic unit accommodated in the holder, wherein the spring sheet comprises:

a main body, the main body comprising a magnetic unit fixing portion and a holder fixing portion;

wherein the magnetic unit fixing portion is used for fixedly connecting with the magnetic unit, the holder fixing portion is used for fixedly connecting with the holder, and the main body is shaped in a non-circular enclosed ring structure;

and the main body comprises two first sidewalls opposite to each other and two second sidewalls opposite to each other;

wherein a first extending portion protruding towards a geometric center of the spring sheet is formed at an inner side of each first sidewall, and the first extending portion forms the magnetic unit fixing portion.

2. The spring sheet as described in claim 1, wherein the main body has a long-axis direction and a short-axis direction; the two first sidewalls extend along the long-axis direction, the two second sidewalls extend along the short-axis direction, and the two first sidewalls and the two second sidewalls cooperatively define an enclosed ring structure.

3. The spring sheet as described in claim 2, wherein the main body further comprises a plurality of oblique portions, wherein each oblique portion is formed between each first sidewall and one adjacent second sidewall of the two second sidewalls.

4. The spring sheet as described in claim 3, wherein an included angle between each oblique portion and each adjacent first sidewall is in a range of 120°-150°.

5. The spring sheet as described in claim 2, wherein a second extending portion protruding towards a geometric center of the spring sheet is formed at an inner side of each second sidewall, and the second extending portion forms the holder fixing portion.

6. The spring sheet as described in claim 5, wherein the holder fixing portion is placed at a middle of each second sidewall.

7. The spring sheet as described in claim 1, wherein an oblique portion is formed at a turning corner of the non-circular enclosed ring structure.

8. The spring sheet as described in claim 7, wherein the main body has a long-axis direction and a short-axis direction; and the main body comprises two first sidewalls opposite to each other and two second sidewalls opposite to each other, wherein the two first sidewalls extend along the long-axis direction, the two second sidewalls extend along the short-axis direction, and the two first sidewalls and the two second sidewalls cooperatively define an enclosed ring structure.

9. The spring sheet as described in claim 8, wherein a first extending portion protruding towards a geometric center of the spring sheet is formed at an inner side of each first sidewall, and the first extending portion forms the magnetic unit fixing portion.

10. The spring sheet as described in claim 9, wherein the magnetic unit fixing portion is placed at a middle of each first sidewall.

11. The spring sheet as described in claim 8, wherein a second extending portion protruding towards a geometric center of the spring sheet is formed at an inner side of each second sidewall, and the second extending portion forms the holder fixing portion.

12. The spring sheet as described in claim 11, wherein the holder fixing portion is placed at the middle of each second sidewall.

13. The spring sheet as described in claim 8, wherein the oblique portion is formed between one first sidewall and an adjacent second sidewall.

14. An electroacoustic device, comprising:

the spring sheet as described in claim 1, a holder, a magnetic unit, and a vibration unit, wherein the magnetic unit and the vibration unit are accommodated in the holder, and wherein the magnetic unit fixing portion is fixedly connected with the magnetic unit, and the holder fixing portion is fixedly connected with the holder.

15. The electroacoustic device as described in claim 14, further comprising:

a support member placed between the holder and the spring sheet;

wherein one end of the support member is fixedly connected with the holder, and the other end of the support member is fixedly connected with the holder fixing portion; and wherein the magnetic unit comprises a magnetic frame, a main magnet located in the magnetic frame, and a pole plate attached onto the main magnet, wherein the magnetic unit fixing portion is fixedly connected with the magnetic frame.

16. An electronic device, comprising the electroacoustic device as described in claim 14.

* * * * *